US008464412B2

(12) United States Patent
Huang et al.

(10) Patent No.: US 8,464,412 B2
(45) Date of Patent: Jun. 18, 2013

(54) CLUTCHING JIG

(75) Inventors: Cheng-Qiang Huang, Guang-Dong (CN); Bing-Tao Yang, Guang-Dong (CN); Yin-Lung Wu, Tu-Cheng (TW); Ming-Chiang Chen, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 789 days.

(21) Appl. No.: 12/689,818

(22) Filed: Jan. 19, 2010

(65) Prior Publication Data

US 2011/0173789 A1 Jul. 21, 2011

(51) Int. Cl.
*B25B 27/14* (2006.01)

(52) U.S. Cl.
USPC ..... 29/278; 29/283

(58) Field of Classification Search
USPC ..... 29/269, 556, 278, 283, 764; 359/819, 359/809; 294/99.1, 99.2; 81/3.8
See application file for complete search history.

(56) References Cited

U.S. PATENT DOCUMENTS 714,989 A * 12/1902 Worthington ..... 294/86.14
850,816 A * 4/1907 Buser ..... 29/278
1,243,150 A * 10/1917 Fox ..... 81/3.8
1,412,201 A * 4/1922 Westerhaus ..... 294/104
2,584,853 A * 2/1952 Elsey ..... 294/86.23
3,251,125 A * 5/1966 Kinkaid et al. ..... 29/764
3,253,327 A * 5/1966 McElligatt ..... 29/741
3,699,629 A * 10/1972 Hood et al. ..... 29/764
3,752,017 A * 8/1973 Lloyd et al. ..... 81/9.44
4,179,803 A * 12/1979 Wolkert ..... 29/741
D264,300 S * 5/1982 Imm ..... D8/28
4,475,283 A * 10/1984 Olson et al. ..... 29/720
4,541,311 A * 9/1985 Trammell, Jr. ..... 81/3.8
4,904,010 A * 2/1990 Lacey et al. ..... 294/116
5,044,058 A * 9/1991 Voss ..... 29/278
5,177,846 A * 1/1993 Bryant ..... 29/237
5,267,493 A * 12/1993 Yamagata et al. ..... 81/3.8
5,588,341 A * 12/1996 Higuchi ..... 81/3.8
5,666,865 A * 9/1997 Ito ..... 81/3.8
5,751,208 A * 5/1998 Martinez ..... 337/198
6,363,596 B1 * 4/2002 Reiter et al. ..... 29/278
6,612,634 B1 * 9/2003 Zoppas ..... 294/106
6,746,454 B2 * 6/2004 Winterbottom et al. ..... 606/99
6,871,567 B2 * 3/2005 Pinana Lopez ..... 81/3.8
7,257,888 B2 * 8/2007 Nelson et al. ..... 29/764
7,359,129 B2 * 4/2008 Chiu et al. ..... 359/809
7,384,086 B2 * 6/2008 Lukaszynski et al. ..... 294/99.2
D603,434 S * 11/2009 Yang et al. ..... D15/140
D626,148 S * 10/2010 Huang et al. ..... D15/5
7,835,090 B1 * 11/2010 Yang et al. ..... 359/808

(Continued)

*Primary Examiner* — Lee D Wilson
*Assistant Examiner* — Jamal Daniel
(74) *Attorney, Agent, or Firm* — Cheng-Ju Chiang

(57) ABSTRACT

A clutching jig includes a first holding bar, a second holding bar, and a fixing means. The first holding bar has a first inner surface, a first end portion and a second end, an engaging portion projected from the first inner surface of the first end portion, and a first recess formed on the second end portion. The second holding bar includes a second inner surface, a third end portion, a fourth end portion, and a second recess formed on the fourth end portion. The fixing means fixes the first end portion with the third end portion. While the clutching jig is assembled, the first inner surface faces the second inner surface, and the engaging portion engages the second inner surface of the third end portion by the fixing means to form a gap between the first inner surface and the second inner surface.

8 Claims, 6 Drawing Sheets

U.S. PATENT DOCUMENTS

| | | | | |
|---|---|---|---|---|
| 8,011,708 | B2 * | 9/2011 | Becker et al. | 294/196 |
| 8,023,207 | B2 * | 9/2011 | Wang et al. | 359/809 |
| 8,033,010 | B2 * | 10/2011 | Wang et al. | 29/764 |
| 8,098,444 | B2 * | 1/2012 | Yu | 359/809 |
| 8,112,879 | B2 * | 2/2012 | Morrison et al. | 29/764 |
| 8,152,213 | B2 * | 4/2012 | Fortune | 294/99.2 |
| 8,186,859 | B2 * | 5/2012 | Shih | 362/438 |
| 8,286,317 | B2 * | 10/2012 | Wang | 29/283 |
| 2008/0068732 | A1 * | 3/2008 | Chiu et al. | 359/809 |
| 2008/0084080 | A1 * | 4/2008 | Hagmann et al. | 294/87.1 |
| 2010/0284096 | A1 * | 11/2010 | Yang et al. | 359/809 |
| 2010/0306980 | A1 * | 12/2010 | Yang et al. | 29/278 |
| 2011/0000062 | A1 * | 1/2011 | Kolasa | 29/278 |
| 2011/0051263 | A1 * | 3/2011 | Wang et al. | 359/809 |
| 2011/0056072 | A1 * | 3/2011 | Wang et al. | 29/764 |
| 2011/0131801 | A1 * | 6/2011 | Nelson et al. | 29/825 |
| 2011/0148129 | A1 * | 6/2011 | Wang | 294/86.4 |
| 2011/0185550 | A1 * | 8/2011 | Yu | 29/283 |
| 2011/0255180 | A1 * | 10/2011 | Yu | 359/809 |

* cited by examiner

CLUTCHING JIG

BACKGROUND OF THE INVENTION

1. Field of the Invention

The invention relates to a clutching jig, and more particularly to an assembled clutching jig with advantages of easy manufacturing, low cost and conveniently fabricating for conveniently disengaging a lens component from a lens socket.

2. The Related Art

As the digital products have been diversely developed, such as personal digital assistants (PDA), mobile phones, or other small portable terminal apparatuses, each of them is broadly combined with a miniature photographing device, such as lens assembly, to perform the photographing function. The lens assembly includes a lens socket and a lens module provided with the lens socket. In the process of assembly and repair, the users usually need to clutch the lens module out of the lens socket.

Please refer to FIG. 5, which shows a lens module 80 and a module socket 90. The lens module 80 has a rectangular lens base 81 and a circular lens body 82 projected from a top surface of the lens base 81. The lateral surface of the circular lens body 82 is projected to form a positioning rib 83. The module socket 90 has a cup-shaped insulating housing 91 formed a receiving space 93 therein and a metal shell 92 enclosing the peripheral of the insulating housing 91. The lateral side of the insulating housing 91 defines a first notch 94. The top of the metal shell 92 is extended a plurality of pressing piece 921 and towards the receiving space 93.

The lens module 80 is inserted into the receiving space 93 of the insulating housing 91 by aligning the positioning rib 83 of the lens module 80 with the first notch 94 of the insulating housing 90 and sliding the rib 83 into the first notch 94. The pressing piece 921 presses the top surface of the lens base 81 for retaining the lens module 80 in the lens socket 90.

Please refer to FIG. 6, which shows a conventional clutching jig 70 including a bar shaped clutching body 71. The clutching body 71 defines a first end 72, a second end 73 opposite to the first end 72, and a lateral surface 74. The clutching body 71 defines a slit 75 axially penetrating thereof and opening on the second end 73, which is formed as U-shaped. The second end 73 of the clutching body 71 defines a concave portion 76. The concave portion 76 is mated with the lens module 80. The second end 73 of the clutching body 71 is further formed a second notch 77 penetrating the lateral surface 74 and connecting to the concave portion 76.

The second end 73 of the clutching jig 70 is inserted into the receiving space 93 of the lens socket 90 by aligning the second notch 77 with the positioning rib 83 of the lens module 80. The positioning rib 83 of the lens module 80 is slid into the second notch 77. The lens module 80 is received in the concave portion 76. The pressing pieces 921 are urged to be apart from the lens module 80 and towards the inner surface of the receiving space 93 by the lateral surface 74 of clutching jig 70. Thus the lens module 80 will be disengaged from the pressing pieces 921. At this time, the clutching body 71 is applied an force to be moved towards the slit 77 to clutch the lens module 80, and pulled upwardly with the lens module 80, then release the lens module 80 from the lens socket 90.

However, the slit 75 of the clutching jig 70 must be formed by line cut procedure. The line cut procedure is complex to raise non-performing ration and the cost of the clutching jig 70.

SUMMARY OF THE INVENTION

An object of the present invention is to provide a clutching jig with advantages of easy manufacturing, low cost and conveniently fabricating.

A clutching jig includes a first holding bar, a second holding bar, and a fixing means. The first holding bar has a first inner surface, a first end portion and a second end portion opposite to the first end portion, an engaging portion projected from the first inner surface of the first end portion, and a first recess formed on the first inner surface of the second end portion.

The second holding bar includes a second inner surface, a third end portion, a fourth end portion opposite to the third end portion, and a second recess formed on the second inner surface of the fourth end portion. The fixing means is used to fix the first end portion of the first holding bar with the third end portion of the second holding bar.

While the first holding bar and the second holding bar are assembled, the first inner surface is arranged to face the second inner surface, the second end portion and the fourth end portion are combined to a clutching end, the first recess and the second recess are combined to a receiving space, the engaging portion engages the second inner surface of the third end portion by the fixing means to form a gap between the first inner surface and the second inner surface and being extending from the engaging portion to the receiving space.

As describe above, the clutching jig is composed of first holding bar, the second holding bar and the fixing means. Each of the first holding bar, the second holding bar and the fixing means can be manufactured individually to avoid line cut procedure. Hence, it is easy to manufacture the clutching jig and it is convenient to fabricate the clutching jig. Each of the first holding bar, the second holding bar and the fixing means of the clutching jig can be replaced individually without replacing whole the clutching jig for decreasing the cost.

BRIEF DESCRIPTION OF THE DRAWINGS

The present invention will be apparent to those skilled in the art by reading the following description thereof, with reference to the attached drawings, in which.

DETAILED DESCRIPTION OF THE PREFERRED EMBODIMENT

Figure 1:
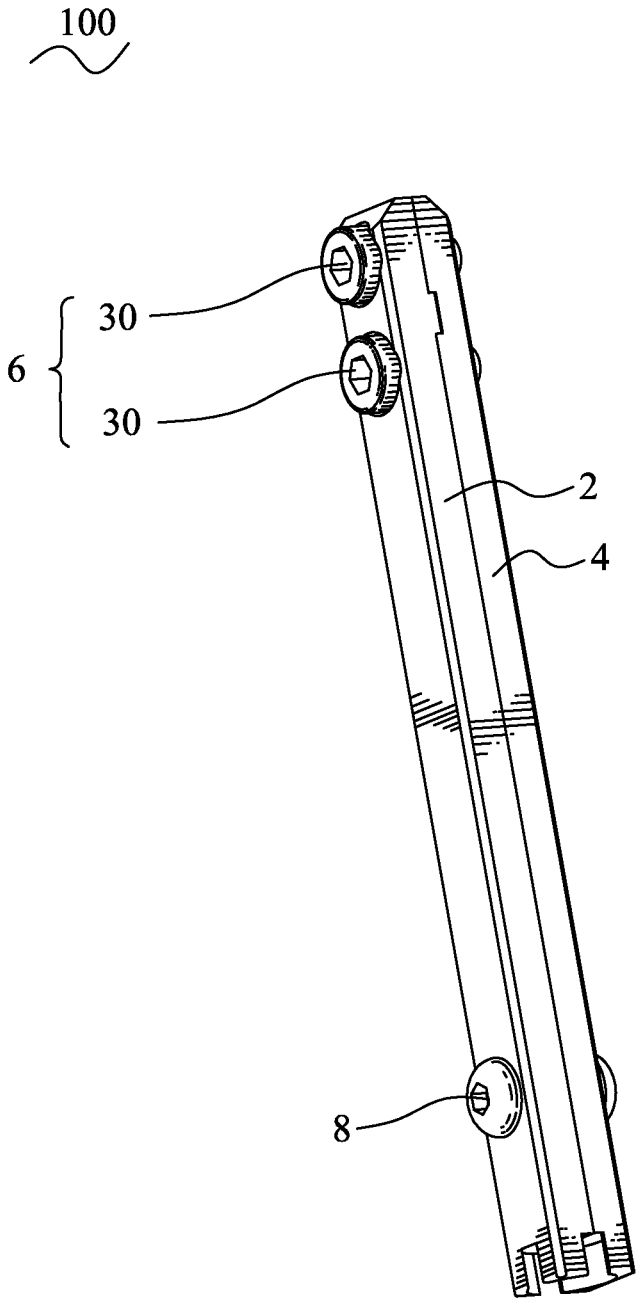
FIG. 1 is a perspective view of a clutching jig of an embodiment according to the present invention.
Figure 2:
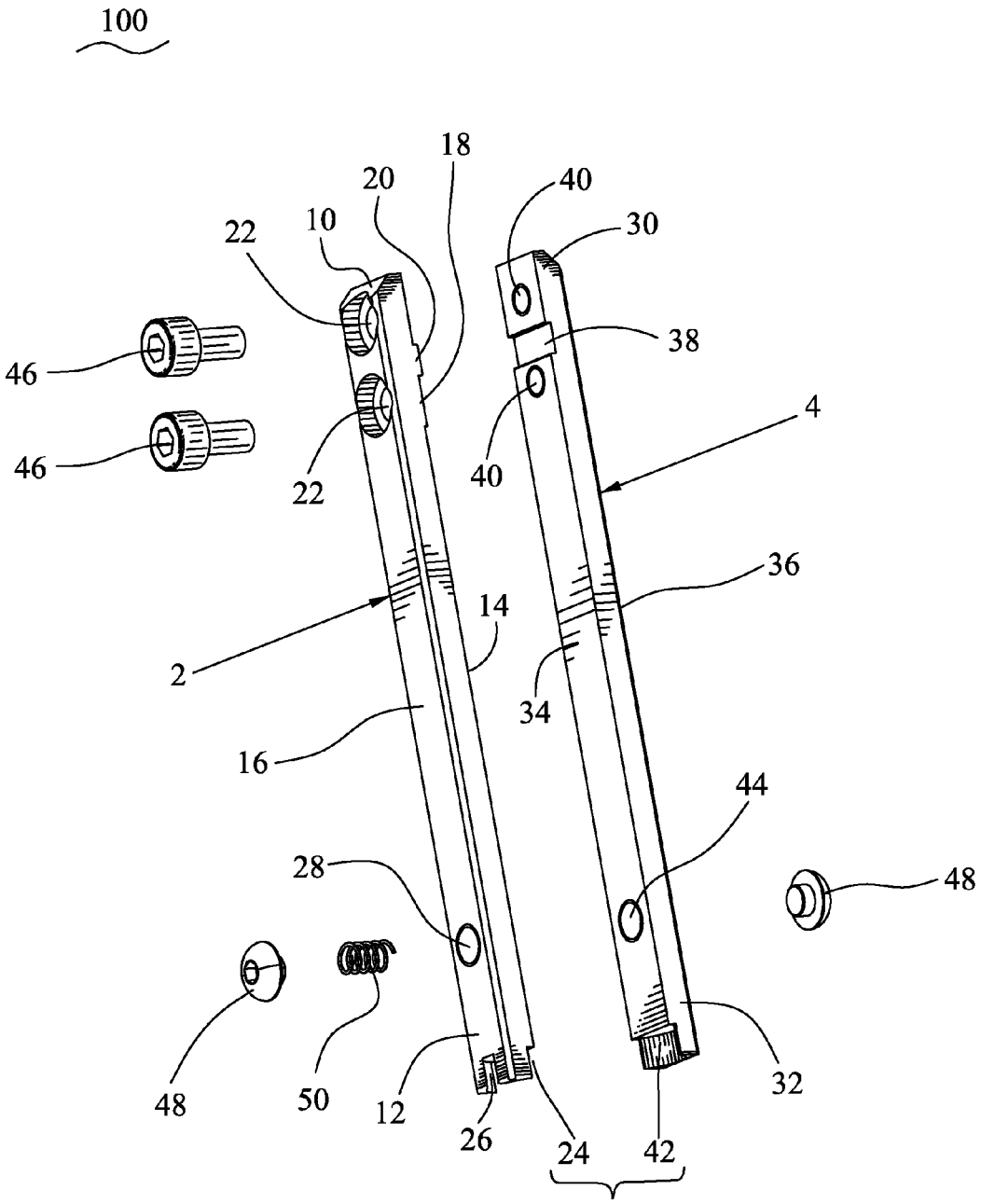
FIG. 2 is an exploded view of the clutching jig according to the present invention.
Figure 3:
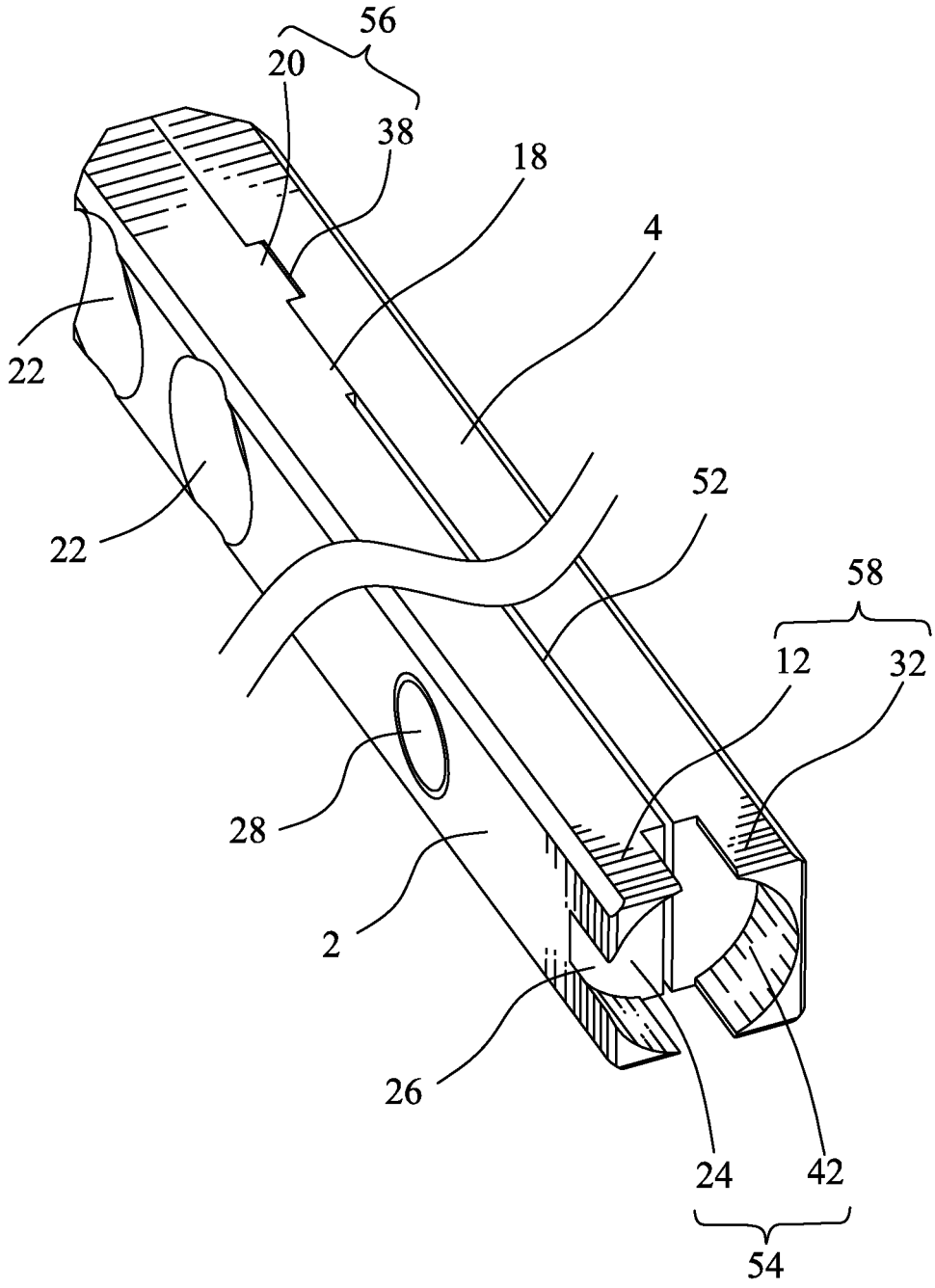
FIG. 3 is a perspective view showing a first holding bar and a second holding bar according to the present invention.

Please refer to FIG. 1 and FIG. 2. FIG. 1 is a perspective view of a clutching jig 100 of a preferred embodiment. FIG. 2 is an exploded view of clutching jig 100 shown in FIG. 1. The clutching jig 100 has a first holding bar 2, a second holding bar 4, a fixing means 6 and an elastic means 8.

The first holding bar 2 has a first end 10, a second end 12, a first inner surface 14 and a first outer surface 16 opposite to the first inner surface 14. The first inner surface 14 of the first end 10 projects an engaging portion 18. Especially, the engaging portion 18 is formed as a platform. The inner surface of the engaging portion 18 projects a positioning projection 20. Especially, the positioning projection 20 is formed as a rib.

The inner surface of the positioning projection 20, the inner surface of the engaging portion 18 and the first inner surface 14 is formed as a stair-shaped. The first end 10 of the first holding bar 2 defines a pair of first fixing holes 22 penetrating the inner surface of the engaging portion 18 and the first outer surface 16. Especially, the positioning projection 20 is formed between the first fixing holes 22.

The second end 12 of the first holding bar 2 is formed a first recess 24 and a positioning notch 28. The positioning notch 28 penetrates the first outer surface 16 and connects the first recess 24. The first holding bar 2 defines a first through hole 28 penetrating the first inner surface 14 and the first outer surface 16 and between engaging portion 18 and the first recess 24. Especially, the first through hole 28 is close to the first recess 24.

The second holding bar 4 has a third end 30, a fourth end 32, a second inner surface 34 and a second outer surface 36 opposite to the second inner surface 34. The third end 30 of the second holding bar 4 is formed a positioning groove 38 on the second inner surface 34 and a pair of second fixing holes 40. The positioning groove 38 is mated with the positioning projection 22 of the first holding bar 2 and formed between the second fixing holes 40. The second fixing holes 40 penetrate the second inner surface 34 and the second outer surface 36, and aligned with the first fixing holes 22 of the first holding bar 2.

The fourth end 32 of the second holding bar 4 defines a second recess 42. The second holding bar 4 defines a second through hole 44 penetrating the second inner surface 34 and the second outer surface 36. The second through hole 44 aligns with the first through hole 28 of the first holding bar 2. The fixing means 6 includes a pair of fixing pin 46. The elastic means 8 includes a pair of restricting pins 48 and a coil spring 50.

While the clutching jig 100 is assembled, the first inner surface 14 of the first holding bar 2 and the second inner surface 34 of the second bar 4 are arranged to face each other. The positioning projection 20 of the first holding bar 2 is received in the positioning groove 38 of the second holding bar 4. Especially, the positioning projection 20 and the positioning groove 38 are combined to a positioning means 56. The engaging portion 18 of the first holding bar 2 abuts against the second inner surface 34 of the third end 30 of the second holding bar 4.

The second end 12 of the first holding bar 2 and the fourth end 32 of the second holding bar 4 are combined to a clutching end 58. The first recess 24 of the first holding bar 2 and the second recess 42 of the second holding bar 4 together form a receiving space 54. Hence, a gap 52 is formed between the first inner surface 14 of the first holding bar 2 and the second inner surface 34 of the second holding bar 4 and extended from the engaging portion 18 to the clutching end 58.

The fixing pins 46 of the fixing means 6 are engaged into the first fixing holes 22 and the second fixing holes 40 for fixing the first holding bar 2 and the second holding bar 4. The coil spring 50 of the elastic means 8 is received in the first through hole 28 and the second through hole 44.

One end of the coil spring 50 is received in the first through hole 28 and abut against one of the restricting pins 48 plugged in the first through hole 28 from the first outer surface 16 of the first holding bar 2. The other end of the coil spring 50 is received in the second through hole 44 and abut against the other one of the restricting pins 48 plugged in the second through hole 44 from the second outer surface 36 of the second holding bar 4.

Figure 4:
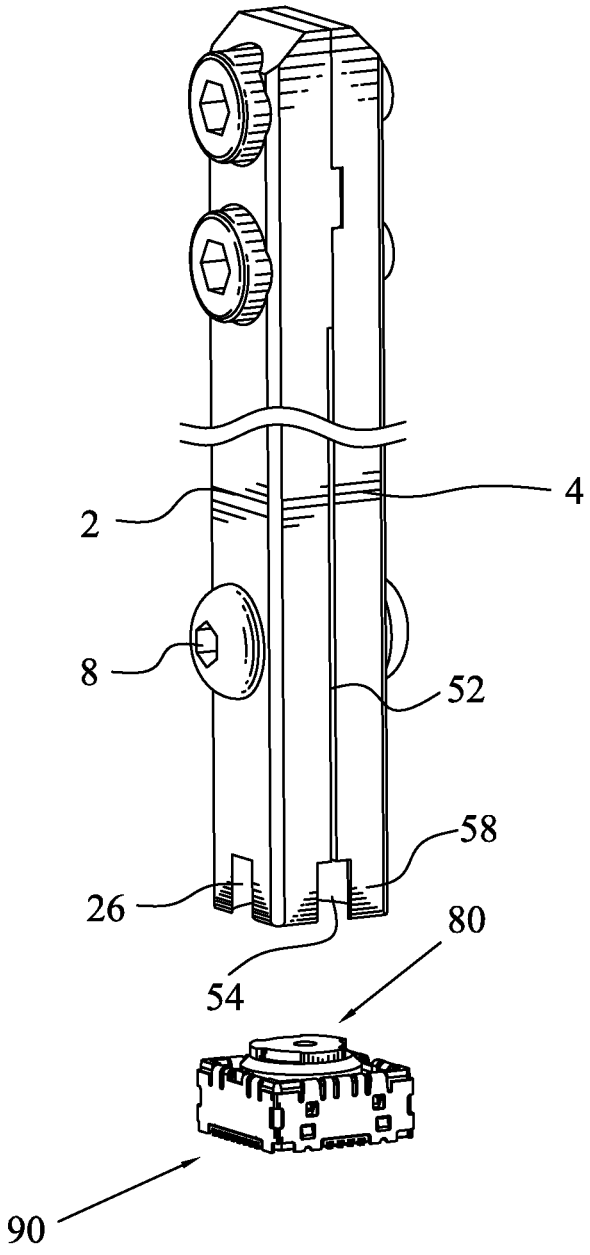
FIG. 4 is a perspective view showing the clutching jig and a lens assembly.
Figure 5:
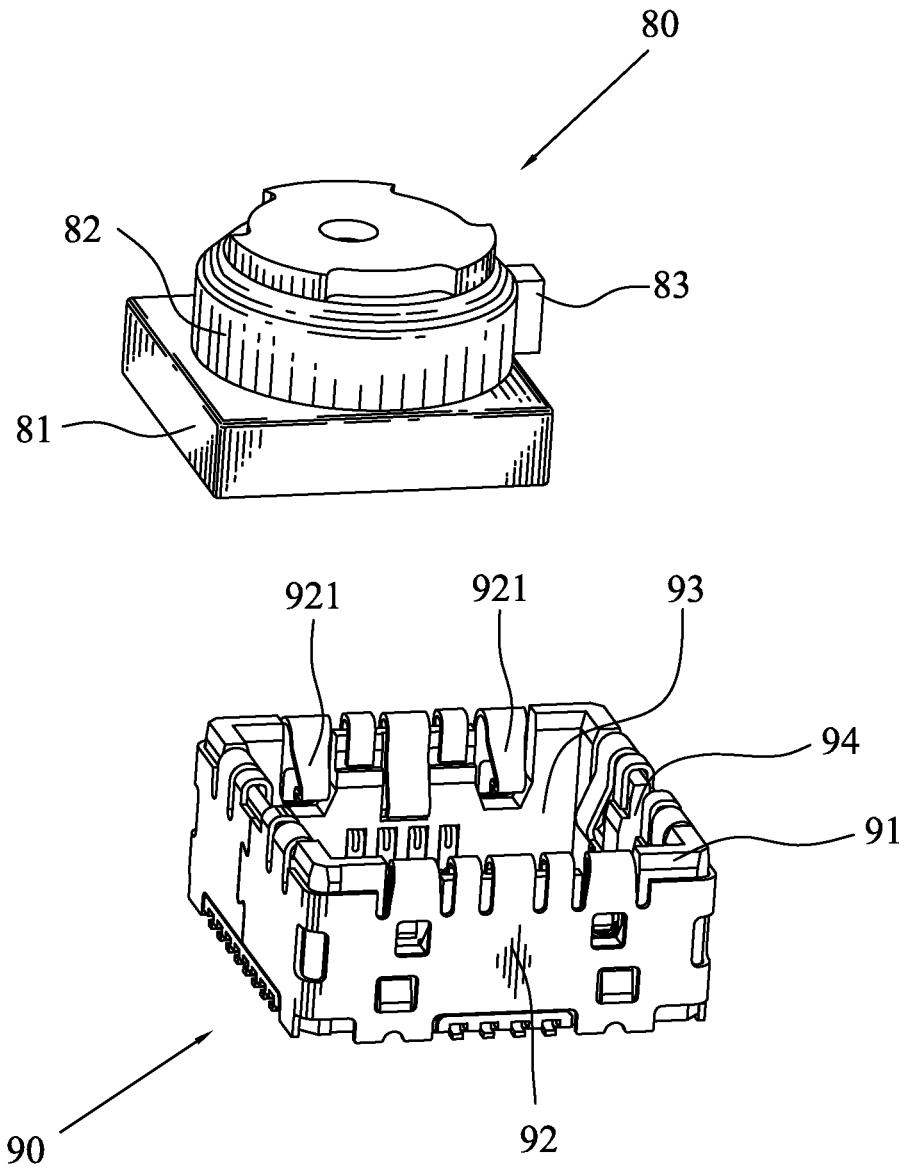
FIG. 5 is a perspective view showing a lens module and a lens socket of the lens assembly.
Figure 6:
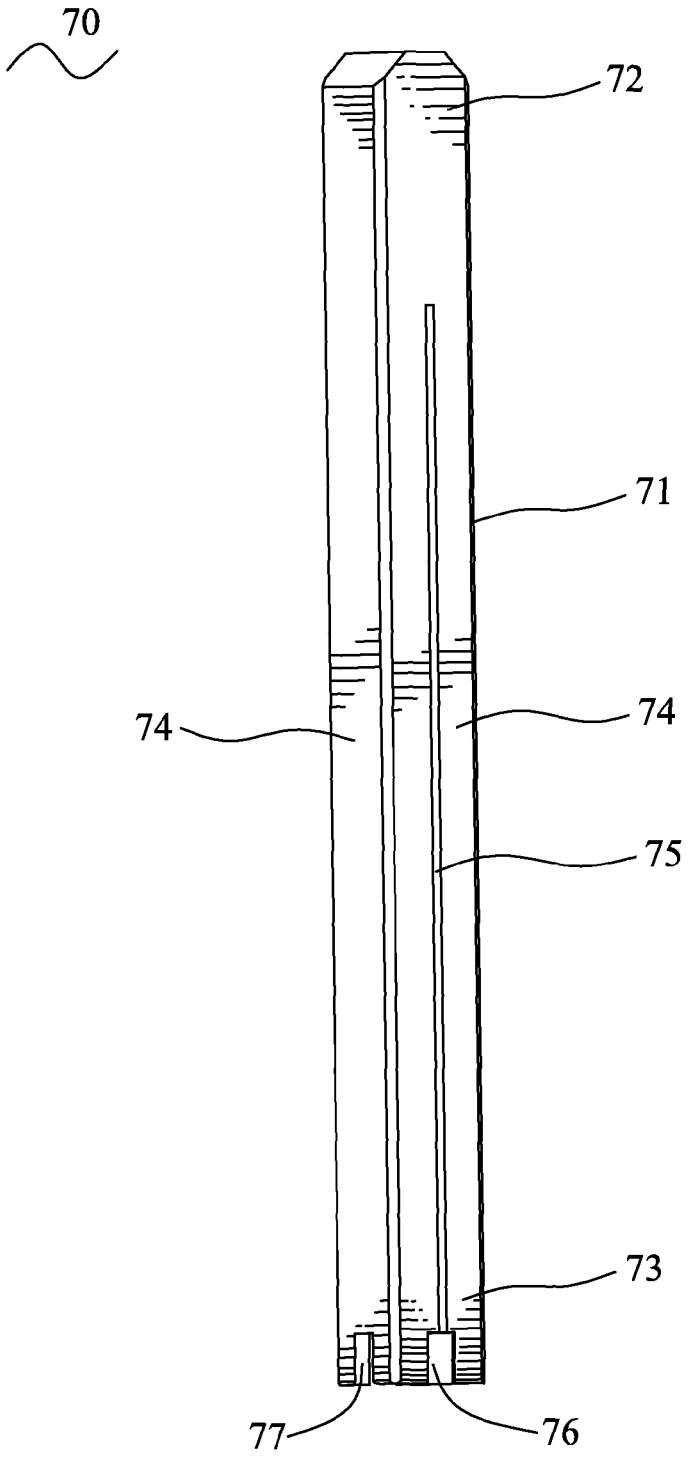
FIG. 6 (Prior Art)
FIG. 6 is a perspective view of a conventional clutching jig.

Please refer to FIG. 4 and FIG. 5, when the clutching jig 100 is used to disengage the lens module 80 from the lens socket 90, the clutching end 58 is inserted into the lens socket 90 by aligning the positioning notch 28 of the clutching jig 100 with the rib 83 of the lens module 80 and the rib 83 being slid into the positioning notch 28.

The lens module 80 is received in the receiving space 54. The pressing pieces 921 are urged to be apart from the lens module 80 by the outer surface of the clutching end 58 of the clutching jig 100. The clutching jig 100 is applied an external force from the first outer surface 16 and second outer surface 36 to urge the first holding bar 2 and the second holding bar 4 to move to each other. Hence, both the distances of the gap 52 and the receiving space 54, which are positioned between the first holding bar 2 and the second holding bar 4, will be narrowed.

Thus, if the lens module 80 is gripped in the receiving space 54, then the clutching end 58 and the lens module 80 gripped in receiving space 54 will be pulled from the lens socket 90. The first holding bar 2 and the second holding bar 4 are urged to return the original position via the coil spring 50 presses the restricting pins 48 and release of the external force. Hence, the lens module 80 is released from the receiving space 54 of the clutching jig 100.

As describe above, the clutching jig 100 is composed of first holding bar, the second holding bar, the fixing means and the elastic means, which are manufactured individually to avoid line cut procedure. Hence, it is easy to manufacture the clutching jig 100. And, it is convenient to fabricate the clutching jig 100. Each of components of the clutching jig 100 can be replaced partly in case the components are damaged, without replacing whole the clutching jig 100 for decreasing the cost.

Furthermore, the present invention is not limited to the embodiment described above; various additions, alterations and the like may be made within the scope of the present invention by a person skilled in the art. For example, respective embodiments may be appropriately combined.

What is claimed is:

1. A clutching jig used to disassemble a lens assembly, comprising:

a first holding bar comprising a first inner surface, a first outer surface opposite to the first inner surface, a first end portion and a second end portion opposite to the first end portion, an engaging portion projected from the first inner surface of the first end portion, and a first recess formed on the first inner surface of the second end portion;

a second holding bar comprising a second inner surface, a second outer surface opposite to the second inner surface, a third end portion, a fourth end portion opposite to the third end portion, and a second recess formed on the second inner surface of the fourth end portion;

a fixing means fixing the first end portion of the first holding bar and the third end portion of the second holding bar, and comprising a pair of first fixing holes formed on the first end portion and penetrating the first inner surface and the first outer surface;

a positioning means for guiding the engaging portion to engage the second inner surface of the third end portion, and comprising at least one positioning projection projecting from the engaging portion and at least one positioning groove formed on the second inner surface of the third end portion for receiving the positioning projection; and an elastic means arranged between the first holding bar and the second holding bar;

wherein the first inner surface is arranged to face the second inner surface, the second end portion and the fourth end portion are combined to a clutching end, the first recess and the second recess are combined to a receiving space, the engaging portion engages the second inner surface of the third end portion by the fixing means to form a gap between the first inner surface and the second inner surface for being extended from the engaging portion to the receiving space, a pair of second fixing holes formed on the third end portion are aligned with the first fixing holes and penetrate the second inner surface and the second outer surface, a pair of fixing pins are respectively engaged into the first fixing holes and the second fixing holes, the positioning groove is formed between the pair of second fixing holes, and the positioning projection is formed between the pair of first fixing holes.

2. The clutching jig as claimed in claim 1, wherein the elastic means is arranged to close to the clutching end.

3. The clutching jig as claimed in claim 2, wherein the elastic means comprising a first through hole formed on the first holding bar and penetrated the first inner surface and the first outer surface, a second through hole formed on the second bar and penetrated the second inner surface and the second outer surface, a coil spring receiving in the first through hole and the second through hole, and a pair of restricting pins, one of the restricting pins engages into the first through hole and abuts against one end of the coil spring, the other one of the restricting pins engages into the second through hole and abuts against the other end of the coil spring.

4. The clutching jig as claimed in claim 3, further comprising a positioning notch formed on the clutching end.

5. A clutching jig used to disassemble a lens assembly, comprising:

a first holding bar comprising a first inner surface, a first outer surface opposite to the first inner surface, a first end portion and a second end portion opposite to the first end portion, and a first recess formed on the first inner surface of the second end portion;

a second holding bar comprising a second inner surface facing to the first inner surface of the first holding bar, a second outer surface opposite to the second inner surface, a third end portion, a fourth end portion opposite to the third end portion, and a second recess formed on the second inner surface of the fourth end portion and aligning with the first recess of the first holding bar;

an engaging portion arranged between and interconnected the first inner surface of the first end portion of the first holding bar and the second inner surface of the third end portion of the second holding bar;

a fixing means fixing the first end portion of the first holding bar, the third end portion of the second holding bar and the engaging portion to form a gap between the first inner surface of the first holding bar and the second inner surface of the second holding bar, the gap extending from the engaging portion to the first recess and the second recess;

a positioning means for positioning the engaging portion between the first end portion of the first holding bar and the third end portion of the second holding bar, and comprising at least one positioning projection projecting from the engaging portion and at least one positioning groove formed on one of the first inner surface of the first end portion of the first holding bar and the second inner surface of the third end portion of the second holding bar for receiving the positioning projection; and an elastic means arranged between the first holding bar and the second holding bar;

wherein the fixing means comprises a pair of first fixing holes formed on the first end portion and penetrating the first inner surface and the first outer surface of the first holding bar, a pair of second fixing holes formed on the third end portion of the second holding bar are aligned with the first fixing holes and penetrate the second inner surface and the second outer surface of the second holding bar, a pair of fixing pins are respectively engaged into the first fixing holes and the second fixing holes, and the positioning groove is formed between the pair of first fixing holes or the pair of second fixing holes.

6. The clutching jig as claimed in claim 5, wherein the elastic means is arranged to close to the second end portion of the first holding bar and the fourth end portion of the second holding bar.

7. The clutching jig as claimed in claim 6, wherein the elastic means comprises a first through hole formed on the first holding bar and penetrating the first inner surface and the first outer surface, a second through hole formed on the second bar and penetrated the second inner surface and the second outer surface, a coil spring receiving in the first through hole and the second through hole, and a pair of restricting pins, one of the restricting pins engages into the first through hole and abuts against one end of the coil spring, the other one of the restricting pins engages into the second through hole and abuts against the other end of the coil spring.

8. The clutching jig as claimed in claim 7, further comprising a positioning notch formed on at least one of the second end portion and the fourth end portion.

* * * * *